US011215388B2

(12) United States Patent
Leman et al.

(10) Patent No.: US 11,215,388 B2
(45) Date of Patent: Jan. 4, 2022

(54) REFRIGERANT CHARGE MANAGEMENT

(71) Applicant: Carrier Corporation, Palm Beach Gardens, FL (US)

(72) Inventors: Derek A. Leman, Brownsburg, IN (US); Matthew T. Austin, Brownsburg, IN (US); Mark W. Shoemaker, Brownsburg, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 152 days.

(21) Appl. No.: 16/718,307

(22) Filed: Dec. 18, 2019

(65) Prior Publication Data

US 2020/0232694 A1 Jul. 23, 2020

Related U.S. Application Data

(60) Provisional application No. 62/794,782, filed on Jan. 21, 2019.

(51) Int. Cl.

| | |
|---|---|
| ***F25B 49/02*** | (2006.01) |
| ***F25B 30/02*** | (2006.01) |
| ***F25B 41/26*** | (2021.01) |
| ***F25B 41/30*** | (2021.01) |
| ***F25B 41/40*** | (2021.01) |

(52) U.S. Cl.

CPC ..... *F25B 49/02* (2013.01); *F25B 30/02* (2013.01); *F25B 41/26* (2021.01); *F25B 41/30* (2021.01); *F25B 41/40* (2021.01)

(58) Field of Classification Search

CPC ..... F25B 30/02; F25B 41/26; F25B 41/30; F25B 41/40; F25B 49/02

See application file for complete search history.

(56) References Cited

U.S. PATENT DOCUMENTS

| | | | | |
|---|---|---|---|---|
| 3,163,016 A | | 12/1964 | Kennedy | |
| 3,237,422 A | | 3/1966 | Pugh | |
| 3,264,337 A | | 8/1966 | Harnish | |
| 3,580,005 A | | 5/1971 | Hale | |
| 4,646,537 A | | 3/1987 | Crawford | |
| 5,140,827 A | * | 8/1992 | Reedy | F25B 13/00 62/174 |
| 5,937,670 A | * | 8/1999 | Derryberry | F25B 13/00 62/324.4 |
| 6,615,602 B2 | | 9/2003 | Wilkinson | |
| 6,826,921 B1 | | 12/2004 | Uselton | |
| 7,191,604 B1 | | 3/2007 | Wiggs | |
| 8,015,836 B2 | | 11/2011 | Kameyama et al. | |

(Continued)

FOREIGN PATENT DOCUMENTS

WO 2012046947 A1 4/2012

*Primary Examiner* — Henry T Crenshaw

(74) *Attorney, Agent, or Firm* — Carlson, Gaskey & Olds, P.C.

(57) ABSTRACT

A system includes an indoor HVAC unit and an outdoor HVAC unit in communication with the indoor HVAC unit. The outdoor HVAC unit comprises a compressor, a vapor header in communication with the indoor HVAC unit and compressor, and at least one check valve to allow vapor refrigerant flow into the indoor HVAC unit during a cooling mode and to prevent liquid refrigerant from exiting the vapor header when in a heating mode. A method of operating said system is also disclosed.

15 Claims, 3 Drawing Sheets

(56) References Cited

U.S. PATENT DOCUMENTS

| | | | | |
|---|---|---|---|---|
| 8,997,509 | B1 | 4/2015 | Wiggs | |
| 9,709,310 | B2 | 7/2017 | Makino et al. | |
| 9,752,803 | B2 | 9/2017 | Matter, III et al. | |
| 9,915,450 | B2 | 3/2018 | Seggerman | |
| 2011/0079032 | A1 | 4/2011 | Taras et al. | |
| 2012/0067070 | A1 | 3/2012 | Albertson | |
| 2014/0260392 | A1* | 9/2014 | Hawkins | F24D 17/0031 62/238.6 |
| 2015/0354862 | A1 | 12/2015 | Hancock | |
| 2017/0016659 | A1* | 1/2017 | Chen | F25B 13/00 |
| 2018/0372354 | A1* | 12/2018 | Brizendine | F24F 11/72 |
| 2019/0024954 | A1* | 1/2019 | Matter | F25B 13/00 |
| 2020/0025396 | A1* | 1/2020 | Leon | F24F 3/153 |

* cited by examiner

REFRIGERANT CHARGE MANAGEMENT

CROSS-REFERENCE TO RELATED APPLICATIONS

This application is a U.S. non-provisional application claiming the benefit of Provisional Application No. 62/794,782, filed on Jan. 21, 2019.

TECHNICAL FIELD

The present disclosure relates generally to a system and method to eliminate charge imbalances between indoor and outdoor coils in a heat pump system.

BACKGROUND

One type of refrigerant system is a heat pump. A heat pump can be utilized to heat air being delivered into an indoor environment to be conditioned, or to cool and typically dehumidify the air delivered into the indoor environment. In a basic heat pump, a compressor compresses a refrigerant and delivers it downstream through a refrigerant flow reversing device, typically a four-way reversing valve. The refrigerant flow reversing device initially routes the refrigerant to an outdoor heat exchanger (outdoor coil), if the heat pump is operating in a cooling mode, or to an indoor heat exchanger (indoor coil), if the heat pump is operating in a heating mode. In the cooling mode of operation, the refrigerant from the outdoor heat exchanger passes through an expansion device, and then passes to the indoor heat exchanger. In the heating mode of operation, the refrigerant passes from the indoor heat exchanger to the expansion device and then to the outdoor heat exchanger. In either case, the refrigerant is routed through the refrigerant flow reversing device back into the compressor. The heat pump may utilize a single bi-directional expansion device or two separate expansion devices.

In recent years, much interest and design effort has been focused on the efficient operation of the heat exchangers (indoor and outdoor) in heat pumps. Higher effectiveness of the refrigerant system heat exchangers directly translates into the augmented system efficiency and reduced life-time cost. However, higher efficiencies are proving more difficult to achieve. In one example, a coil size of the outdoor coil can be increased to achieve a higher efficiency; however, the size of the indoor coil is limited by standard sizes allotted for indoor units. Larger outdoor coils relative to indoor coils can cause charge imbalances that can significantly reduce heating performance.

SUMMARY OF THE INVENTION

In one exemplary embodiment, a heat pump system includes an indoor HVAC unit and an outdoor HVAC unit in communication with the indoor HVAC unit. The outdoor HVAC unit includes a compressor, a vapor header in communication with the indoor HVAC unit and compressor, and at least one check valve to allow liquid refrigerant flow into the indoor HVAC unit during a cooling mode and to prevent liquid refrigerant from exiting the vapor header when in a heating mode.

In another example of the above, the outdoor HVAC unit further includes: a first distributor having a first inlet that receives high pressure liquid refrigerant and a plurality of first outlets that deliver the high pressure liquid refrigerant to the vapor header when in the heating mode; and a second distributor having a second inlet that receives high pressure liquid refrigerant and a plurality of second outlets that deliver vapor and/or lower pressure refrigerant to the vapor header when in the heating mode.

In another example of any of the above, the outdoor HVAC unit further includes an expansion valve in operable communication with the second distributor.

In another example of any of the above, the vapor header includes: a plurality of fluid circuits; and the at least one check valve includes at least a first check valve positioned in a first fluid circuit of the plurality of fluid circuits and a second check valve positioned in a second fluid circuit of the plurality of fluid circuits.

In another example of any of the above, the plurality of fluid circuits are spaced apart from each other in a vertical direction.

In another example of any of the above, the first fluid circuit includes a topmost fluid circuit and the second fluid circuit comprises a bottommost fluid circuit in the vertical direction.

In another example of any of the above, when operating in the cooling mode, the indoor HVAC unit is configured to receive liquid refrigerant from the first and second distributors and then send vapor refrigerant to the compressor before returning to the vapor header.

In another example of any of the above, when operating in the heating mode, the indoor HVAC unit is configured to receive vapor refrigerant exiting the vapor header via the compressor and return liquid refrigerant to the first and second distributors.

In another exemplary embodiment, an outdoor HVAC unit includes a compressor, a vapor header in communication with the indoor HVAC unit and compressor, and at least one check valve to allow liquid refrigerant flow into the indoor HVAC unit during a cooling mode and to prevent liquid refrigerant from exiting the vapor header when in a heating mode.

In another example of any of the above, the outdoor HVAC unit further includes: a first distributor having a first inlet that receives high pressure liquid refrigerant and a plurality of first outlets that deliver the high pressure liquid refrigerant to the vapor header when in the heating mode; and a second distributor having a second inlet that receives high pressure liquid refrigerant and a plurality of second outlets that deliver vapor and/or lower pressure refrigerant to the vapor header when in the heating mode.

In another example of any of the above, the vapor header includes: a plurality of fluid circuits; and the at least one check valve comprises at least a first check valve positioned in a first fluid circuit of the plurality of fluid circuits and a second check valve positioned in a second fluid circuit of the plurality of fluid circuits.

An exemplary method of operating an HVAC system includes the steps of: operating a HVAC system, in at least one of a heating mode and a cooling mode, wherein the HVAC system includes an indoor HVAC unit in fluid communication with an outdoor HVAC unit; wherein the outdoor HVAC unit includes a compressor, a vapor header in communication with the indoor HVAC unit and the compressor, and at least one check valve in fluid communication with the vapor header; operating the at least one check valve to allow liquid refrigerant flow into the indoor HVAC unit while operating in the cooling mode; and operating the at least one check valve to prevent liquid refrigerant from exiting the vapor header while operating in the heating mode.

In another example of the above described method, the outdoor HVAC unit further includes a first distributor and a second distributor, the method further includes; operating the first distributor to receive high pressure liquid refrigerant via a first inlet and to deliver the high pressure liquid refrigerant to the vapor header via a plurality of first outlets when operating in the heating mode; and operating the second distributor to receive high pressure liquid refrigerant via a second inlet and to deliver vapor and/or lower pressure refrigerant to the vapor header via a plurality of second outlets when operating in the heating mode.

In another example of any of the above described methods, the vapor header includes a plurality of fluid circuits, and the at least one check valve comprises at least a first check valve and a second check valve, the method further includes: positioning the first check valve in a first fluid circuit; and positioning the second check valve in a second fluid circuit to prevent the high pressure liquid refrigerant from exiting the first and second fluid circuits when operating in the heating mode.

In another example of any of the above described methods, the method further includes spacing the plurality of fluid circuits apart from each other in a vertical direction.

In another example of any of the above described methods, the method further includes locating the first fluid circuit in a topmost fluid circuit and locating the second fluid circuit in a bottommost fluid circuit in the vertical direction.

In another example of any of the above described methods, the method further includes, when operating in the cooling mode, configuring the indoor HVAC unit to receive liquid refrigerant from the first and second distributors and then send vapor refrigerant to a compressor before returning to the vapor header.

In another example of any of the above described methods, the method further includes, when operating in the heating mode, configuring the indoor HVAC unit to receive vapor refrigerant exiting the vapor header of the outdoor HVAC unit via the compressor and return liquid refrigerant to the first and second distributors.

These and other features of the present invention can be best understood from the following specification and drawings, the following of which is a brief description.

DETAILED DESCRIPTION

Figure 1:
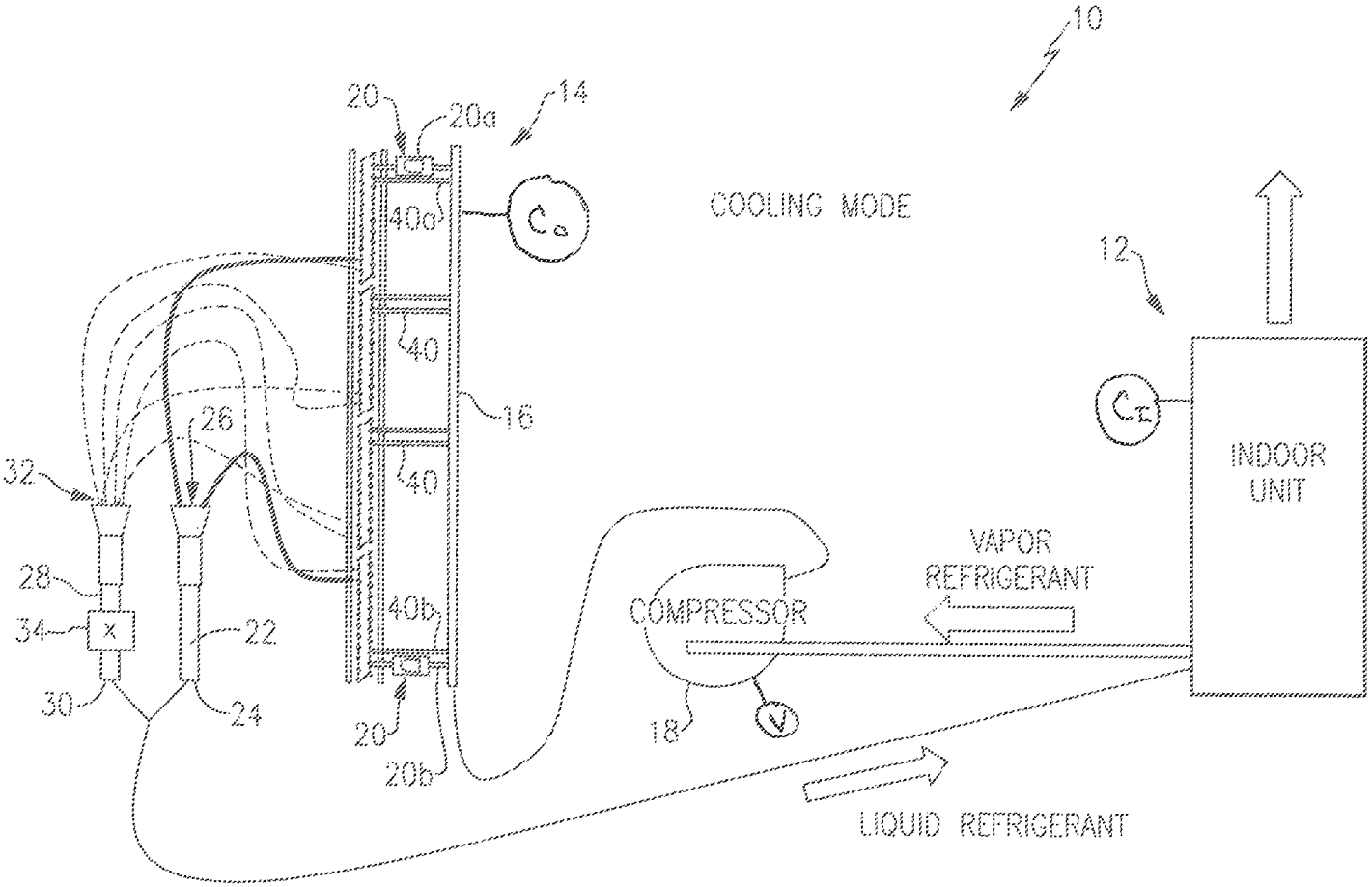
FIG. 1 schematically illustrates a heat pump system operating in a cooling mode.
Figure 2:
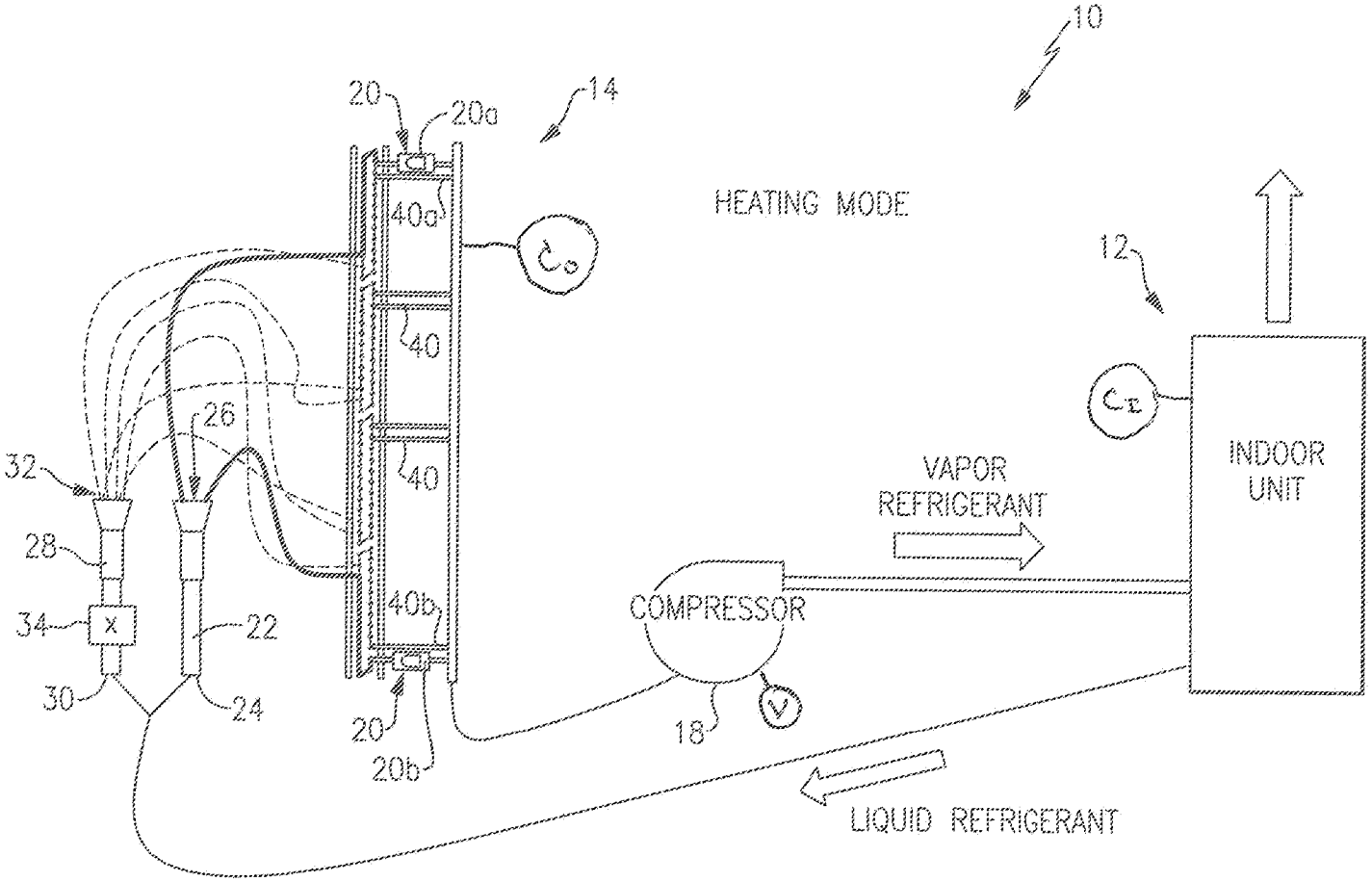
FIG. 2 schematically illustrates a heat pump system operating in a heating mode.

FIGS. 1 and 2 schematically illustrates a heating, ventilation, and air conditioning (HVAC) unit with a heat pump system 10 that includes an indoor HVAC unit 12 comprising an indoor coil $C_I$ (heat exchanger) and an outdoor HVAC unit 14 comprising an outdoor coil $C_O$ (heat exchanger). The outdoor unit 14 has a vapor header 16 in fluid communication with a compressor 18 that is in communication with the indoor unit 12. The compressor 18 has a high pressure gas discharge connected to a reversing four-way valve (schematically shown at V). Any conventional four-way valve can be used, and as known, these valves include a movable element, within a sealed casing which can be positioned to change the flow path between flow lines connected to the valve. By selectively positioning the four-way valve, the connection to the discharge side and suction side of the compressor can be reversed between the indoor and outdoor coils.

When the outdoor HVAC unit 14 is operating as a condenser, i.e. the system 10 is in a cooling cycle, the indoor unit 12 is operating as an evaporator. When operating as an evaporator, the liquid refrigerant is changed to a vaporous gas in the indoor HVAC unit 12. Compressed refrigerant is passed from compressor 18 into the outdoor HVAC unit 14 where the refrigerant condenses. The liquid refrigerant then flows to the indoor HVAC unit 12, which functions as an evaporator. The gaseous refrigerant passes from the indoor HVAC unit 12 into a suction line of the compressor 18.

When the indoor HVAC unit 12 functions as condenser (the system 10 is in the heating mode of operation as shown in FIG. 2), the outdoor HVAC unit 14 is operating as an evaporator. When operating as a condenser, the high pressure gas condenses to a liquid in the indoor HVAC unit 12. During the heating cycle, the compressed refrigerant flows from the compressor 18 and then into the indoor HVAC unit 12. After passing the indoor and outdoor HVAC units 14 and 12, the refrigerant from the outdoor HVAC unit 14 returns to the suction line of compressor 18.

The subject disclosure uses distributers and check valves with the outdoor unit 14 to use full outdoor cooling capacity in combination with only using a limited number of outdoor circuits for heating. This combination eliminates the issue of charge imbalances and maximizes cooling and heating performance for a given outdoor coil.

Figure 3:
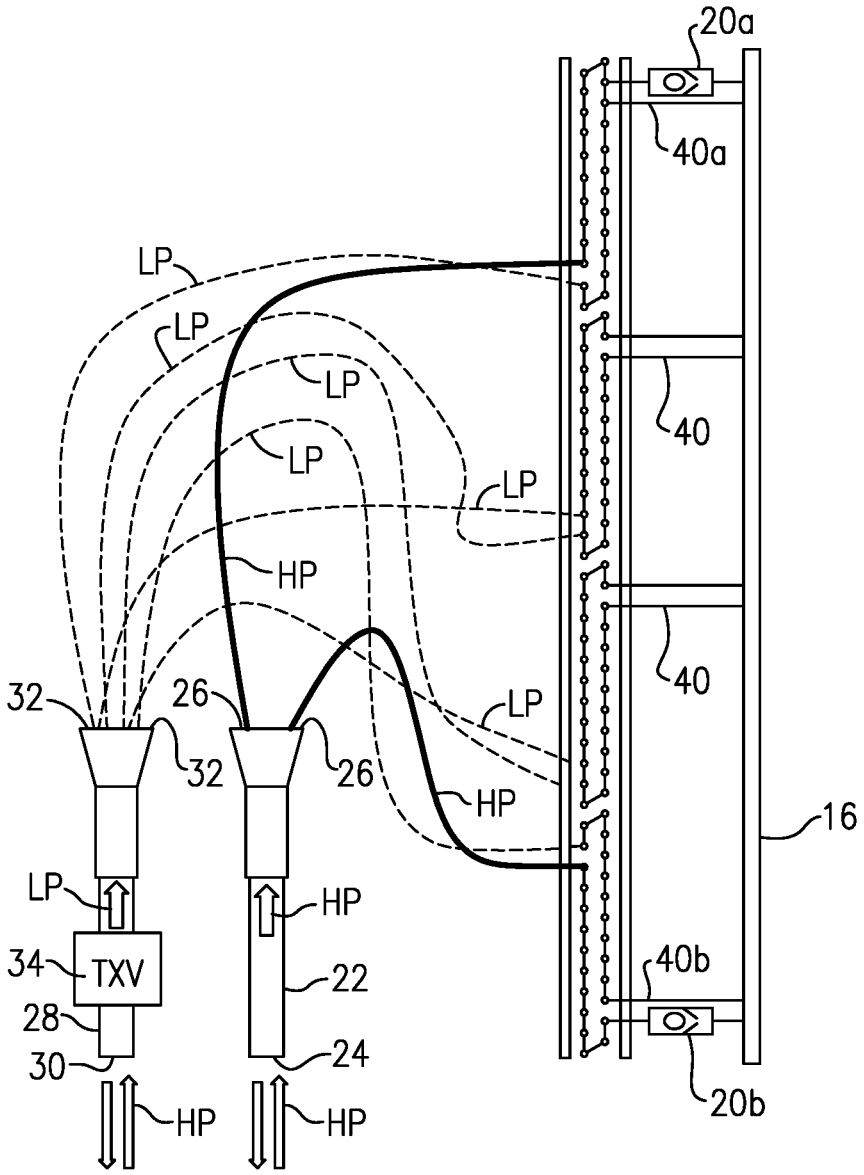
FIG. 3 schematically illustrates a check valve location in a vapor header of an outdoor unit.

As shown in the example in FIG. 3, the outdoor HVAC unit 14 includes at least one check valve 20 to allow vapor refrigerant flow into the indoor HVAC unit 12 during the cooling mode and to prevent liquid refrigerant from exiting the vapor header 16 when in the heating mode. In one example, the check valve 20 comprises a one-way check valve. A first distributor 22 has an inlet 24 that receives high pressure liquid refrigerant HP and a plurality of outlets 26 that deliver the high pressure liquid refrigerant HP to the vapor header 16 when in the heating mode. A second distributor 28 has an inlet 30 that receives high pressure liquid refrigerant HP and a plurality of second outlets 32 that deliver vapor and/or lower pressure refrigerant LP to the vapor header 16 when in the heating mode. The second distributor 28 includes an expansion valve 34 such that a lower pressure expansion occurs and provides a two-phase liquid.

FIG. 1 shows a cooling mode of the system 10, where the indoor HVAC unit 12 operates as an evaporator (not shown) that receives liquid refrigerant from the first 22 and second 28 distributors and that then sends vapor refrigerant to the compressor 18 before returning to the vapor header 16. The vapor header 16 includes a plurality of fluid circuits 40. In this example, the at least one check valve 20 comprises at least a first check valve 20*a* positioned in a first fluid circuit 40*a* and a second check valve 20*b* positioned in a second fluid circuit 40*b*. The high pressure liquid refrigerant entering the vapor header 16 is prevented from exiting the first 40*a* and second 40*b* fluid circuits by the first 20*a* and second 20*b* check valves during the heating mode. The high pressure liquid refrigerant can exit the vapor header 16 via the fluid circuits 40 that do not include the check valves 20. The check valves 20*a*, 20*b* allow vapor refrigerant flow during the cooling mode.

When in the heating mode, as shown in FIG. 2, the indoor HVAC unit 12 operates as a condenser that receives vapor refrigerant exiting the compressor 18. The compressor 18 receives liquid refrigerant from the fluid circuits 40 of the vapor header 16 that do not include check valves 20, i.e. only a limited number of outdoor circuits are being used when in the heating mode. The indoor HVAC unit 12 returns the liquid refrigerant to the first 22 and second 28 distributors.

In one example, the plurality of fluid circuits 40 are spaced apart from each other in a vertical direction. The at least one check valve 20 can be placed in any of the fluid circuits 40. As discussed above, in one example configuration, there is a first check valve 20*a* positioned in a first fluid circuit 40*a* and a second check valve 20*b* positioned in a second fluid circuit 40*b*. In one example, the first fluid circuit 40*a* comprises a topmost fluid circuit and the second fluid circuit 40*b* comprises a bottommost fluid circuit. Thus, in this example configuration, the first check valve 20*a* is positioned in the topmost fluid circuit and the second check valve 20*b* is positioned in the bottommost fluid circuit. These two fluid circuits 40*a*, 40*b* are the least efficient circuits, so placing the check valves in these locations has less impact on overall operating efficiency. The high pressure liquid refrigerant HP in the vapor header 16 that enters the topmost and bottommost fluid circuits remains condensed and is unable to exit these circuits because of the one-way check valves. This allows charge to be stored during the heating mode. The topmost and bottommost circuits allow vapor refrigerant flow during the cooling mode.

The subject invention provides a system and method of using liquid distributors and check valves to use the full outdoor coil for cooling in combination with using a limited number of outdoor circuits for heating, which eliminates the issue of charge imbalances. The invention also maximizes cooling and heating performance for a given outdoor coil. Further, the invention eliminates the need for a charge compensator and removes limitations pertaining to outdoor coil size.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A heat pump system comprising:

an indoor HVAC unit comprising an indoor coil; and an outdoor HVAC unit comprising an outdoor coil, the outdoor HVAC unit in communication with the indoor HVAC unit, the outdoor HVAC unit comprising a compressor in communication with a reversing valve, a vapor header in communication with the indoor HVAC unit and compressor, and at least one check valve to allow liquid refrigerant flow into the indoor HVAC unit during a cooling mode and to prevent liquid refrigerant from exiting the vapor header when in a heating mode, a first distributor having a first inlet that receives high pressure liquid refrigerant and a plurality of first outlets that deliver the high pressure liquid refrigerant to the vapor header when in the heating mode, and a second distributor having a second inlet that receives high pressure liquid refrigerant and a plurality of second outlets that deliver vapor and/or lower pressure refrigerant to the vapor header when in the heating mode.

2. The heat pump system of claim 1, wherein the outdoor HVAC unit further comprises an expansion valve in operable communication with the second distributor.

3. The heat pump system of claim 1, wherein the vapor header comprises:

a plurality of fluid circuits; and wherein the at least one check valve comprises at least a first check valve positioned in a first fluid circuit of the plurality of fluid circuits and a second check valve positioned in a second fluid circuit of the plurality of fluid circuits.

4. The heat pump system of claim 3, wherein the plurality of fluid circuits are spaced apart from each other in a linear direction.

5. The heat pump system of claim 4, wherein the first fluid circuit is at one end of the vapor header and the second fluid circuit is at an opposite end of the vapor header in the linear direction.

6. The heat pump system of claim 3, wherein, when operating in the cooling mode, the indoor HVAC unit is configured to receive liquid refrigerant from the first and second distributors and then send vapor refrigerant to the compressor before returning to the vapor header.

7. The heat pump system of claim 6, wherein, when operating in the heating mode, the indoor HVAC unit is configured to receive vapor refrigerant exiting the vapor header via the compressor and return liquid refrigerant to the first and second distributors.

8. An outdoor HVAC unit comprising:

a compressor;

a vapor header in communication with an indoor HVAC unit and compressor;

at least one check valve to allow liquid refrigerant flow into the indoor HVAC unit during a cooling mode and to prevent liquid refrigerant from exiting the vapor header when in a heating mode; and wherein the vapor header comprises:

a plurality of fluid circuits, and wherein the at least one check valve comprises at least a first check valve positioned in a first fluid circuit of the plurality of fluid circuits and a second check valve positioned in a second fluid circuit of the plurality of fluid circuits.

9. The outdoor HVAC unit of claim 8, further comprising:

a first distributor having a first inlet that receives high pressure liquid refrigerant and a plurality of first outlets that deliver the high pressure liquid refrigerant to the vapor header when in the heating mode; and a second distributor having a second inlet that receives high pressure liquid refrigerant and a plurality of second outlets that deliver vapor and/or lower pressure refrigerant to the vapor header when in the heating mode.

10. A method of operating an HVAC system, the method comprising:

operating a HVAC system, in at least one of a heating mode and a cooling mode, wherein the HVAC system comprises an indoor HVAC unit in fluid communication with an outdoor HVAC unit, wherein the indoor HVAC unit comprises an indoor coil and wherein the outdoor HVAC unit comprises an outdoor coil;

wherein the outdoor HVAC unit comprises a compressor in communication with a reversing valve, a vapor header in communication with the indoor HVAC unit and the compressor, and at least one check valve in fluid communication with the vapor header;

operating the at least one check valve to allow liquid refrigerant flow into the indoor HVAC unit while operating in the cooling mode;

operating the at least one check valve to prevent liquid refrigerant from exiting the vapor header while operating in the heating mode;

wherein the outdoor HVAC unit further comprises a first distributor and a second distributor, the method further comprising:

operating the first distributor to receive high pressure liquid refrigerant via a first inlet and to deliver the high pressure liquid refrigerant to the vapor header via a plurality of first outlets when operating in the heating mode; and operating the second distributor to receive high pressure liquid refrigerant via a second inlet and to deliver vapor and/or lower pressure refrigerant to the vapor header via a plurality of second outlets when operating in the heating mode.

11. A method of operating an HVAC system, the method comprising:

operating a HVAC system, in at least one of a heating mode and a cooling mode, wherein the HVAC system comprises an indoor HVAC unit in fluid communication with an outdoor HVAC unit;

wherein the indoor HVAC unit comprises an indoor coil and wherein the outdoor HVAC unit comprises an outdoor coil;

wherein the outdoor HVAC unit comprises a compressor in communication with a reversing valve, a vapor header in communication with the indoor HVAC unit and the compressor, and at least one check valve in fluid communication with the vapor header;

operating the at least one check valve to allow liquid refrigerant flow into the indoor HVAC unit while operating in the cooling mode;

operating the at least one check valve to prevent liquid refrigerant from exiting the vapor header while operating in the heating mode; and wherein the vapor header includes a plurality of fluid circuits, and the at least one check valve comprises at least a first check valve and a second check valve, the method further comprising:

positioning the first check valve in a first fluid circuit; and positioning the second check valve in a second fluid circuit to prevent the high pressure liquid refrigerant from exiting the first and second fluid circuits when operating in the heating mode.

12. The method of claim 11, including spacing the plurality of fluid circuits apart from each other in a linear direction.

13. The method of claim 12, including locating the first fluid circuit at one end of the vapor header and locating the second fluid circuit at an opposite end of the vapor header in the linear direction.

14. The method of claim 10, further comprising when operating in the cooling mode, configuring the indoor HVAC unit to receive liquid refrigerant from the first and second distributors and then send vapor refrigerant to a compressor before returning to the vapor header.

15. The method of claim 10, further comprising when operating in the heating mode, configuring the indoor HVAC unit to receive vapor refrigerant exiting the vapor header of the outdoor HVAC unit via the compressor and return liquid refrigerant to the first and second distributors.

* * * * *